United States Patent [19]

Williams et al.

[11] Patent Number: 4,538,709

[45] Date of Patent: Sep. 3, 1985

[54] WHEELED GARMENT BAG

[75] Inventors: Marvin E. Williams, Worthington; David B. Chaney, Columbus; Donald J. Rebele, Worthington, all of Ohio

[73] Assignee: The Huntington National Bank, Columbus, Ohio

[21] Appl. No.: 512,734

[22] Filed: Jul. 11, 1983

[51] Int. Cl.[3] ..... A45C 5/14; A45C 13/26; A45C 13/30; A45C 13/38

[52] U.S. Cl. ..... 190/18 A; 190/115; 206/287.1; 248/188.5; 280/37; 280/47.17

[58] Field of Search ..... 190/18 R, 18 A, 115, 190/39; 206/287.1; 280/34, 47, 17, 47.26, DIG. 3; 248/188.5

[56] References Cited

U.S. PATENT DOCUMENTS

| | | | |
|---|---|---|---|
| 1,215,369 | 2/1917 | Hart | 248/188.5 X |
| 2,427,841 | 9/1947 | Dichter | 248/188.5 X |
| 2,581,417 | 1/1952 | Jones | 190/18 A X |
| 2,689,631 | 9/1954 | Marks | 206/287.1 X |
| 2,957,187 | 10/1960 | Raia | 248/188.5 X |
| 3,522,955 | 8/1970 | Warner, Jr. | 190/18 A X |
| 3,559,777 | 2/1971 | Gardner | 190/111 X |
| 3,606,372 | 9/1971 | Browning | 190/115 X |
| 3,891,230 | 6/1975 | Mayer | 190/18 A X |
| 3,934,895 | 1/1976 | Fox | 190/18 A X |
| 4,030,768 | 6/1977 | Lugash | 190/18 A X |
| 4,036,336 | 7/1977 | Burtley | 190/18 A |
| 4,062,429 | 12/1977 | Tabor et al. | 190/18 A |
| 4,256,320 | 3/1981 | Hager | 280/37 |
| 4,262,780 | 4/1981 | Samuelian | 190/18 A |

FOREIGN PATENT DOCUMENTS

| | | | |
|---|---|---|---|
| 0021918 | 1/1981 | European Pat. Off. | 190/18 A |
| 2056657 | 5/1972 | Fed. Rep. of Germany | 190/18 A |
| 2359229 | 6/1975 | Fed. Rep. of Germany | 190/18 A |
| 1301349 | 4/1969 | France | 280/47.17 |

*Primary Examiner*—William Price
*Assistant Examiner*—Sue A. Weaver
*Attorney, Agent, or Firm*—Frank H. Foster

[57] ABSTRACT

A multipurpose piece of luggage with wheels and a collapsible handle having a garment enclosure in which large articles of clothing may be hung and lesser enclosures for storage of small articles. The invention also serves as a cart for other luggage. Its handle may be collapsed, support feet retracted and garment enclosure folded to give it the appearance and utility of a normal suitcase.

4 Claims, 12 Drawing Figures

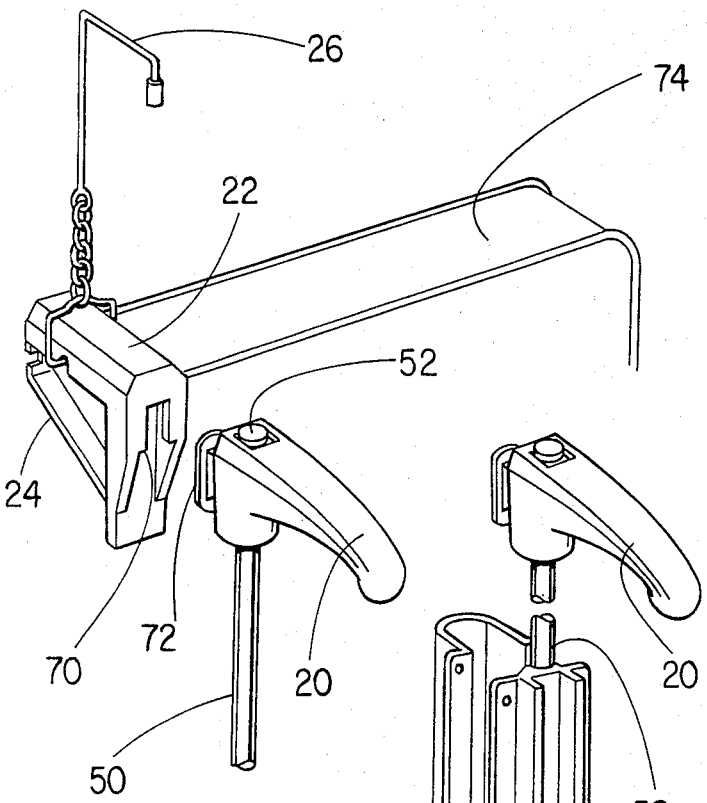
Fig. 6
Fig. 7a
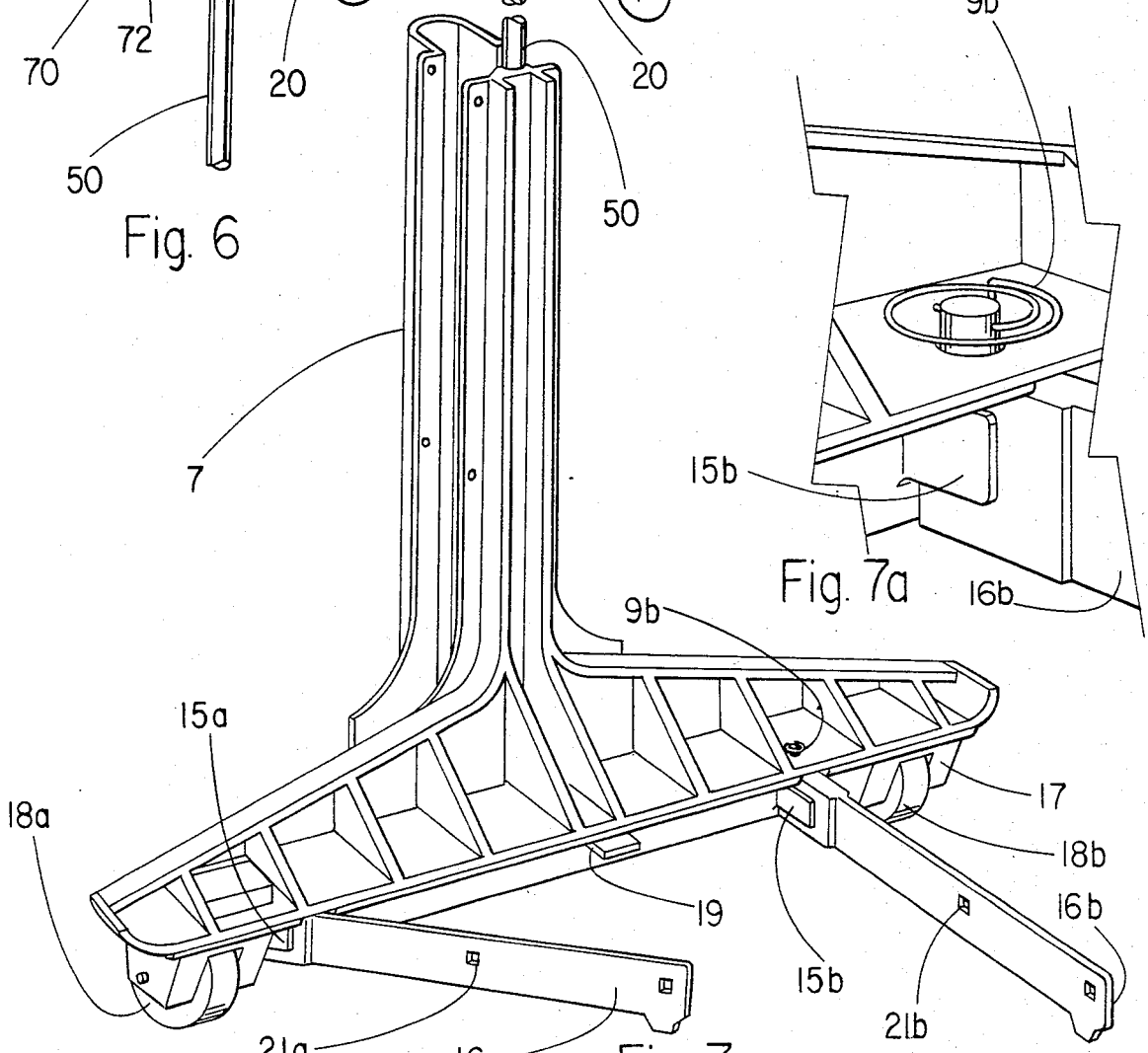
Fig. 7

WHEELED GARMENT BAG

TECHNICAL FIELD

The present invention relates to wheeled, hand-held luggage suitable for airline carry on use. In particular, the present invention relates to multipurpose, collapsible luggage capable of performing as a cart for additional bags and as a self-supporting garment bag.

BACKGROUND ART

Traditionally the traveller has had a choice of hand-held luggage consisting of suitcases, lightweight "carry on" bags, and garment bags. Suitcases can carry an ample amount of articles, but clothing such as dresses, coats, or suits must be folded and thereby wrinkled when placed inside. The resultant package is generally heavy and cumbersome. Wheels and handles have been added to suitcases in prior inventions, but the luggage, though more mobile, does not leave a traveller's clothing looking fresh. The suitcase is not generally fit for the "business" traveller, who only needs to carry one or two days worth of clothing and would prefer to transport all his needs in a single piece of carry on luggage in order to save time otherwise spent waiting for his luggage to be unloaded from aircraft. The business traveller gains the added benefit of not risking the loss of his luggage when he is able to store all his needs in a single carry on piece of luggage.

Lightweight carry on bags do not allow a traveller to store longer articles of clothing without their being folded and, thus, wrinkled. Secondly, when lightweight carry on bags are used in conjunction with other luggage they must be carried separately adding to the traveller's burdens and causing him to have to pick up, position, and put down all his luggage between each time he is required to use his hands.

Garment bags are usually bulky and cumbersome. When carried over one's arms the articles of clothing are still subject to folding and wrinkling. Any smaller items carried in a garment bag, such as folded shirts or toiletry articles, usually fall to the bottom of the bag in a disorderly manner. Attempts to make the garment bags more like a big suitcase have resulted in a large rigid piece of luggage, which, when in conjunction with a number of other bags, only adds to the difficulties of a traveller attempting to carry all his luggage and intermittently stop and use his hands. For example, the wheeled garment bag disclosed in Lugash U.S. Pat. No. 4,030,768 provides a rigid, mobile bag capable of carrying long pieces of clothing without folding. It even provides for a hook to temporarily hold a lightweight bag, such as a brief case, but the invention disclosed still only compounds a traveller's problems when he attempts to transport the garment bag in conjunction with two or more suitcases.

BRIEF DISCLOSURE OF THE INVENTION

The preferred embodiment of the present invention has a base support unit. Assembled to this unit are wheels and spring loaded, retractable support feed. Affixed to the upper portion of the base support unit is a telescoping pole attached to a handle.

The garment enclosure is manufactured from a durable, flexible material. Within the enclosure is a hanger bar. The enclosure is large enough to hang a number of suits or dresses. The garment enclosure, when in an operable position is held rigid from its lower portion to its center by the base support unit. The upper portion of the enclosure may be folded over or held in an upright position against the extended telescoping pole. In either position the invention may be pushed or pulled along by using the handle attached to the extended telescoping pole. When the garment enclosure is folded over and the telescoping pole collapsed, both the pole and its handle are concealed within a zippered lining. An auxiliary handle affixed to the center of the garment enclosure may be used to carry the invention when it is in the folded position.

Retractable, spring loaded support feet may be extended to have additional luggage rested upon them. Regardless of the position of the garment enclosure, the invention serves as a free standing luggage cart.

Fashioned to the outer wall of the garment enclosure are smaller, additional enclosures suitable for carrying articles of lesser size.

An object of this invention is to provide a traveller with a piece of multipurpose luggage capable of hanging large articles of clothing without folding them while providing separate storage for smaller articles.

An object of this invention is to provide a traveller with a multipurpose piece of luggage that also doubles as a cart for smaller pieces of luggage.

Another object of this invention is to provide a soft-sided carry on garment enclosure that may be hung for storage and with the handle and telescoping tube support collapsed into the bag it can be folded to be stored in tight places.

An additional object of this invention is to provide a piece of luggage with wheels and a handle that may act as a garment bag and is free standing.

BRIEF DESCRIPTION OF THE DRAWINGS

FIG. 6 is a perspective view of the garment enclosure's bracket assembly and corresponding handle clip device.

FIGS. 7 and 7*a* are a front perspective view of the base support unit with the garment enclosure removed illustrating the wheel and retractable foot support assemblies and including a blow up of one spring assembly.

Figures 1, 1A:
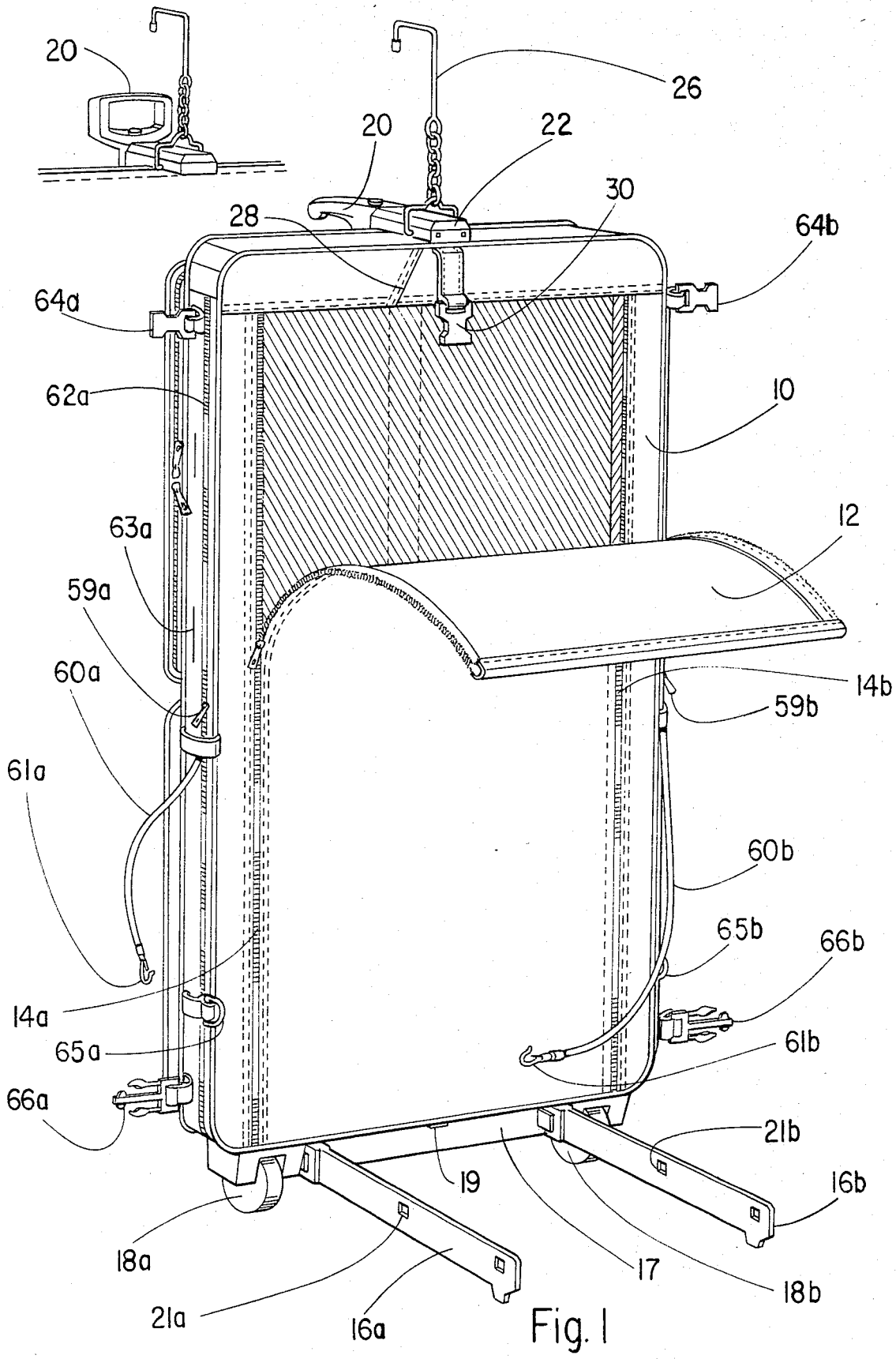
FIG. 1 is a perspective view showing the inward side of the garment enclosure and the retractable support feet extended and with two handle designs.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Referring to FIG. 1 a base support unit 17 having wheels 18*a* and 18*b* holds the invention upright by means of support feet 16*a* and 16*b*. The inward side of the garment enclosure 10 is illustrated. Access to the inner portion of the garment enclosure 10 is achieved by opening flap 12 with the use of the flap zippers 14*a* and 14*b*. An optional strap 30 may be used to assist in holding flap 12 closed. Large articles of clothing on hangers may be suspended within the garment enclosure 10 by use of an inner hanger bar 24 (FIG. 6). In the preferred embodiment this bar is designed to slant downward such that the first articles of clothing hung inside the garment enclosure 10 slide downward and into the enclosure away from the flap 12. When upright the entire invention may itself be hung in a closet or onto some other device by the use of hanger hook 26. A hook pocket 28 is provided to store the hanger hook 26 when it is not in use.

Figure 2:
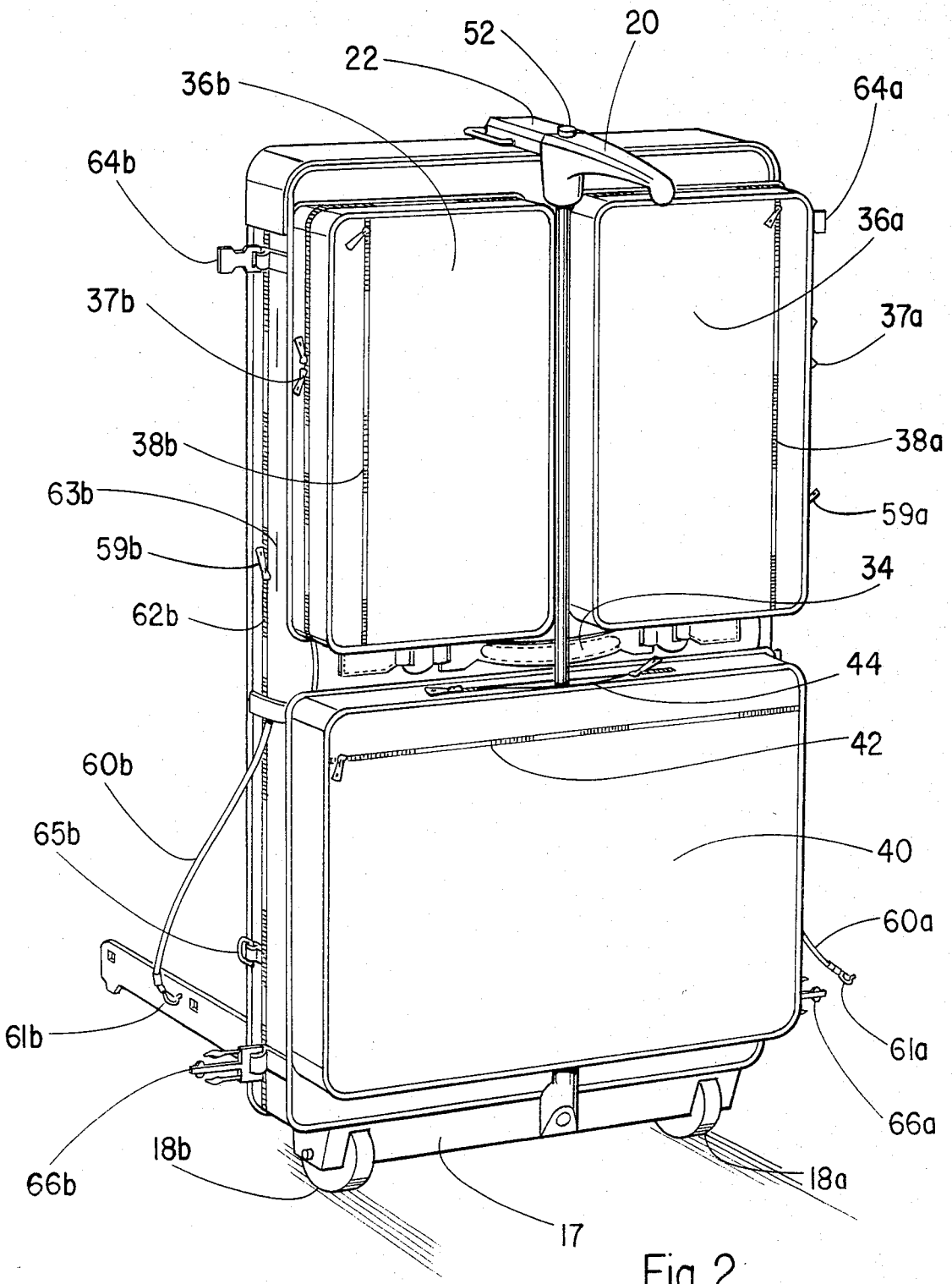
FIG. 2 is a perspective view of a preferred embodiment of the outward side of the garment enclosure with an arrangement of smaller enclosures.

In FIG. 2 the outward side of the garment enclosure 10 is illustrated in the upright position and shows a alternative handle design. This preferred embodiment illustrates an arrangement for two small enclosures 36*a* and 36*b* and one medium enclosure 40. The small enclosures 36*a* and 36*b* are designed in the preferred embodiment to accomodate a number of folded shirts or similar garments. In an alternative, less expensive embodiment of the invention, the two small enclosures are absent and storage is provided by a pocket in the lining of the garment enclosure. Access to the small enclosures 36*a* and 36*b* is through access zipper 37*a* and 37*b* respectively. Access to the medium enclosure is through access zipper 42. An additional feature of the preferred embodiment is a storage pocket for papers provided in the linings of small enclosures 36*a* and 36*b* with access through zipper 38*a* and 38*b* respectively. The pockets provide quick storage and retrieval for items such as newspapers or airplane tickets. The fashioning of the small and medium enclosures to the exterior of the garment enclosure overcomes drawbacks found in prior art. By providing compartmentalized storage space outside of the garment enclosure smaller items may be packed or removed without first having to remove the large articles of clothing stored within the garment enclosure. Additionally, small bulky items such as shoes are not pressed directly against suits or dresses, thereby not causing those items to be wrinkled, torn or soiled.

Figure 3:
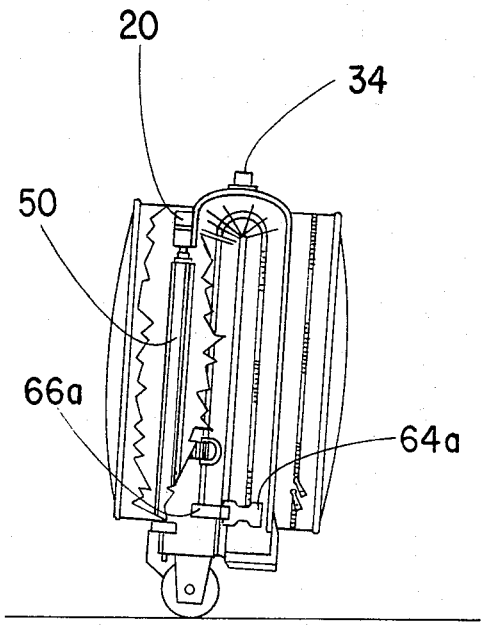
FIG. 3 is a side elevation with the telescoping pole collapsed and the garment enclosure folded.
Figure 5:
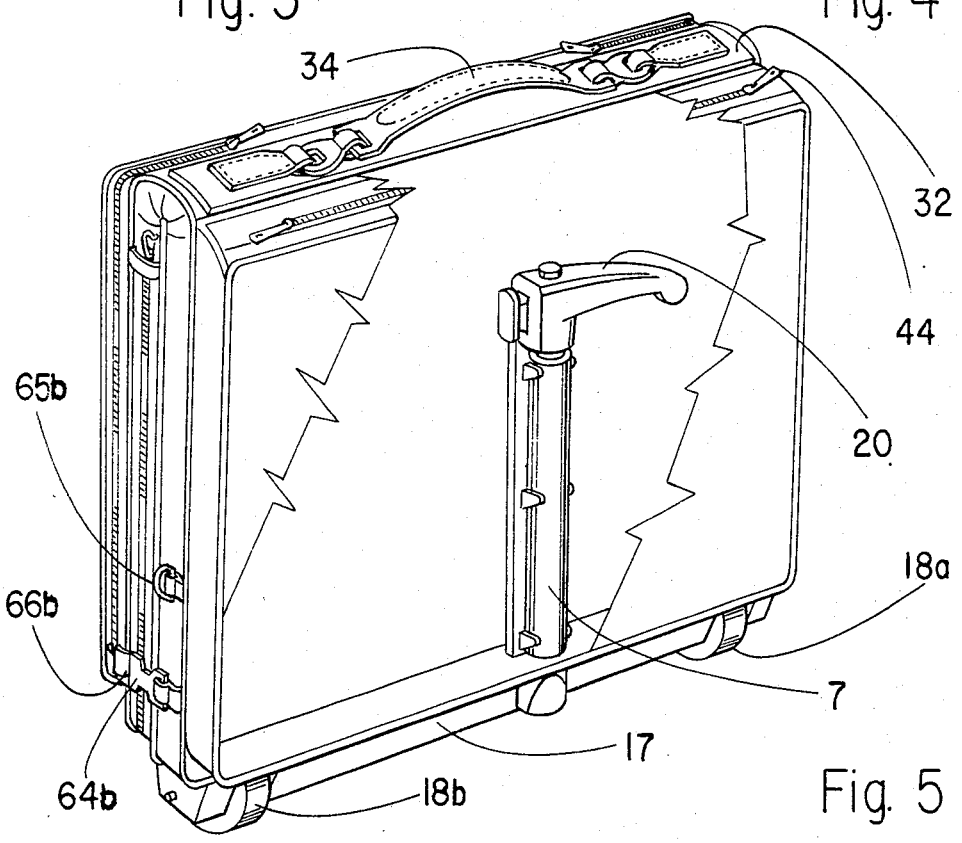
FIG. 5 is a top perspective view of the garment enclosure in a folded position with the handle collapsed.

As indicated in FIGS. 3 and 5 the garment enclosure 10 may be folded over to form a piece of luggage approximately the same size as a normal carry on bag. The preferred embodiment when folded is designed to fit neatly into tight spaces. Even when the invention is in a folded position it will function as a cart for additional luggage which may be rested upon the support feet 16*a* and 16*b*. A telescoping pole 50 with an attached handle 20 locks into an extended position and provides a means for the traveller to push or pull the bag without having to stoop or bend over to pick up the handle.

Figure 4:
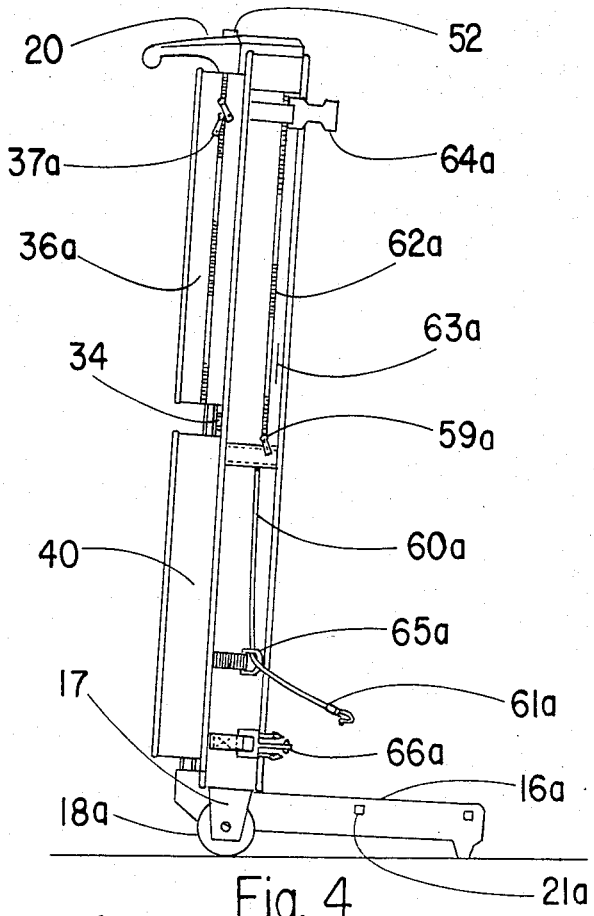
FIG. 4 is a side elevation with the garment enclosure in an upright position.

As indicated in FIGS. 1, 3 and 4 male clasps 66*a* and 66*b* and female clasps 64*a* and 64*b* are provided to retain the garment enclosure 10 in a folded position. FIG. 1 and FIG. 4 demonstrate the provisions in the preferred embodiment for rings 65*a* and 65*b* to be used for strapping additional luggage to the invention. Also provided in the preferred embodiment are stretch cords 60*a* and 60*b* with terminal hooks 61*a* and 61*b* for use in securing additional luggage to the invention. These cords may be used in three positions to secure additional luggage to the invention. For large pieces of luggage the cords may simply be extended around the luggage and attached to one another by their respective hooks 61*a* and 61*b*. Secondly, for smaller parcels, the cords may be extended downward through the rings 65*a* and 65*b* and then joined together by their respective hooks. Lastly, the hooks may be attached to holes 21*a* and 21*b* in the support legs 16*a* and 16*b* to brace very large items. These stretch cords 60*a* and 60*b* with their respective hooks 61*a* and 61*b* may be stored out of sight within tubular pockets 63*a* and 63*b*. A non-opening zipper 62*a* or 62*b* keeps the tubular pockets 63*a* or 63*b* closed when the zipper glides 59*a* and 59*b*, that are attached to an end of stretch cords 60*a* or 60*b*, are used to pull or extend the stretch cords 60*a* or 60*b* into or out of the tubular pockets 63*a* or 63*b*.

In FIG. 5 the top of the invention is illustrated with the support feet 16*a* and 16*b* retracted out of sight and the garment enclosure 10 in a folded position. Telescoping pole 50 has been collapsed and concealed along with handle 20 in a compartment beneath the zipper 44. When the invention is in this position it assumes the size and appearance of a normal suitcase. Auxiliary handle 34 is used to carry the invention. Auxiliary handle 34 in the preferred embodiment is affixed to a support shoulder 32 that, when the invention is in the folded position, acts it's spine and provides lateral dimension to the invention.

In FIG. 6 the handle 20 is illustrated in two embodiments with a button snap 72 and the telescoping pole 50 almost fully extended. The garment enclosure 10 is in the upright position. A bracket assembly 22 has a notched receptacle 70. As the telescoping pole 50 is being fully extended the notched receptacle 70 receives the button snap 72. Once the telescoping pole 50 is fully extended it locks itself automatically in the extended position. The notched receptacle 70 of the bracket assembly 22 thereby is held rigidly in an upright position. The bracket assembly 22 supports the end of the garment enclosure 10 in a lateral dimension by use of an inner shoulder support 74. When the garment enclosure 10 is to be folded on the telescoping pole 50 and its handle 20 stored, a release button 52 on the handle 20 is depressed and the locking mechanism of the telescoping pole 50 releases. The button snap 72 will then slide down and out of the notched receptacle 70 allowing the garment enclosure 10 to be folded. Regardless of the design of the handle, the function of button snap and the release button remain the same and either version allows the invention to be comfortable pushed along.

Referring to FIG. 7 the base support unit 17 is illustrated in detail. Support feet 16*a* and 16*b* are movably attached to be base support unit 17 by hinges 15*a* and 15*b* respectively. The support feet 16*a* and 16*b* automatically rotate outward from a folded position because of the tension supplied by springs 9*a* and 9*b*. A plastic tab hook 19 attached to the base support unit 17 in the preferred embodiment snaps on top of the support feet and retains them in their folded position. The preferred embodiment of the invention, when the garment enclosure 10 is folded, will sit in an upright position with the support feet 16*a* and 16*b* extended or folded. When the traveller desires to extend the support feet 16*a* and 16*b* he may do so by using his foot to unsnap the tab hook 19 from the support feet 16*a* and 16*b*. The support feet 16*a* and 16*b* will then spring to an extended position.

FIG. 7 also illustrates another feature of the preferred embodiment of the base support unit 17. A durable sleeve 7 provides a protective shell around the telescoping tube 50. When the telescoping tube is collapsed and stored inside of the concealment zipper 44 this sleeve will protect the telescoping pole 50 from being bent by objects either contained or outside of the invention.

Figure 8:
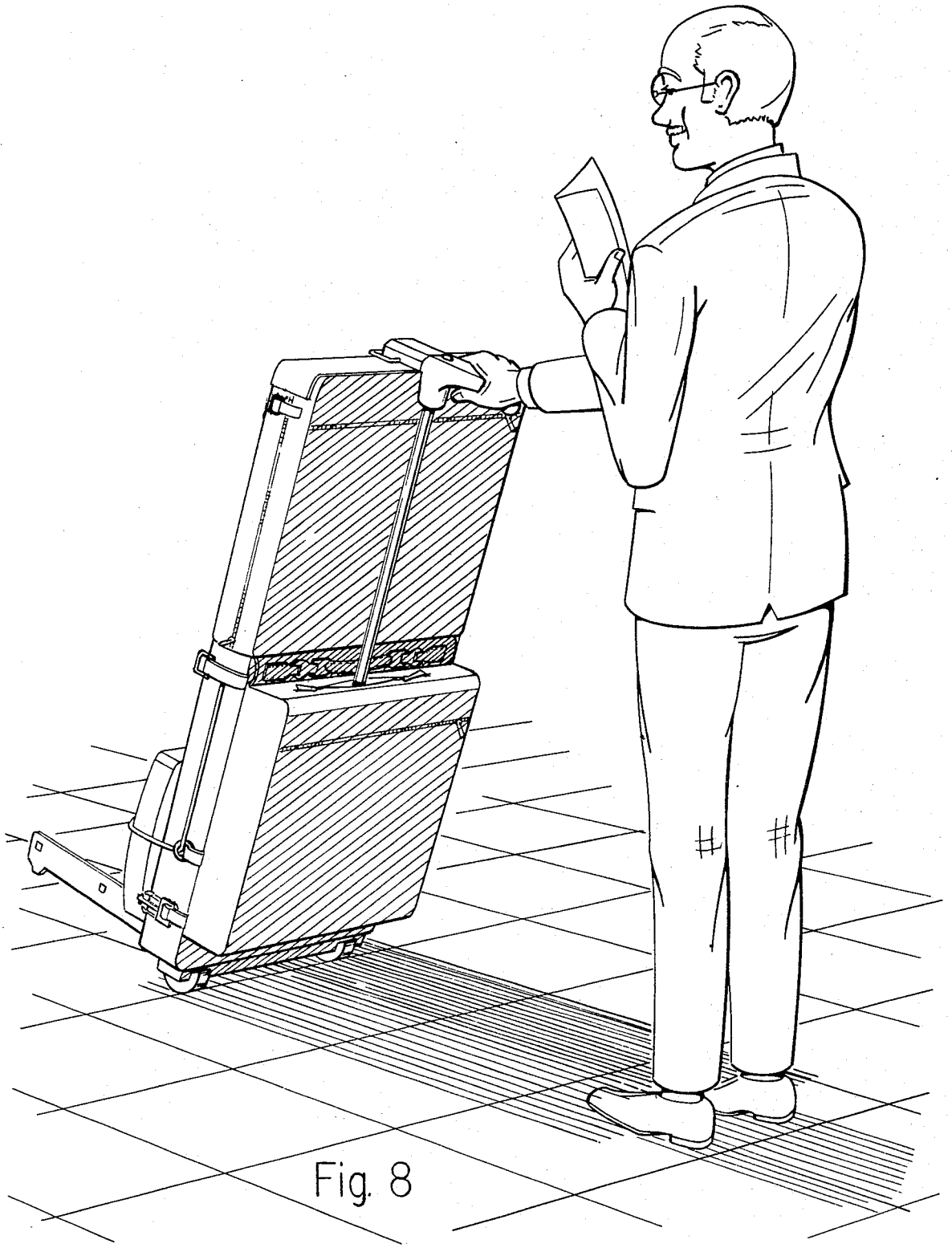
FIG. 8 is a perspective view of the invention in its operable position while being pushed and carrying a brief case.

FIG. 8 illustrates an alternative embodiment of the invention with a medium size enclosure 40, but no small enclosures 36*a* or 36*b*. This version of the invention may be made less expensively than the preferred embodiment, but does not lack any of the significant features of the invention. A pocket may be fashioned in the lining of the invention in place of the small enclosures in order to allow for storage of some additional articles such as folded shirts or trousers. In this view alternative handle design 20 is shown.

Figure 9:
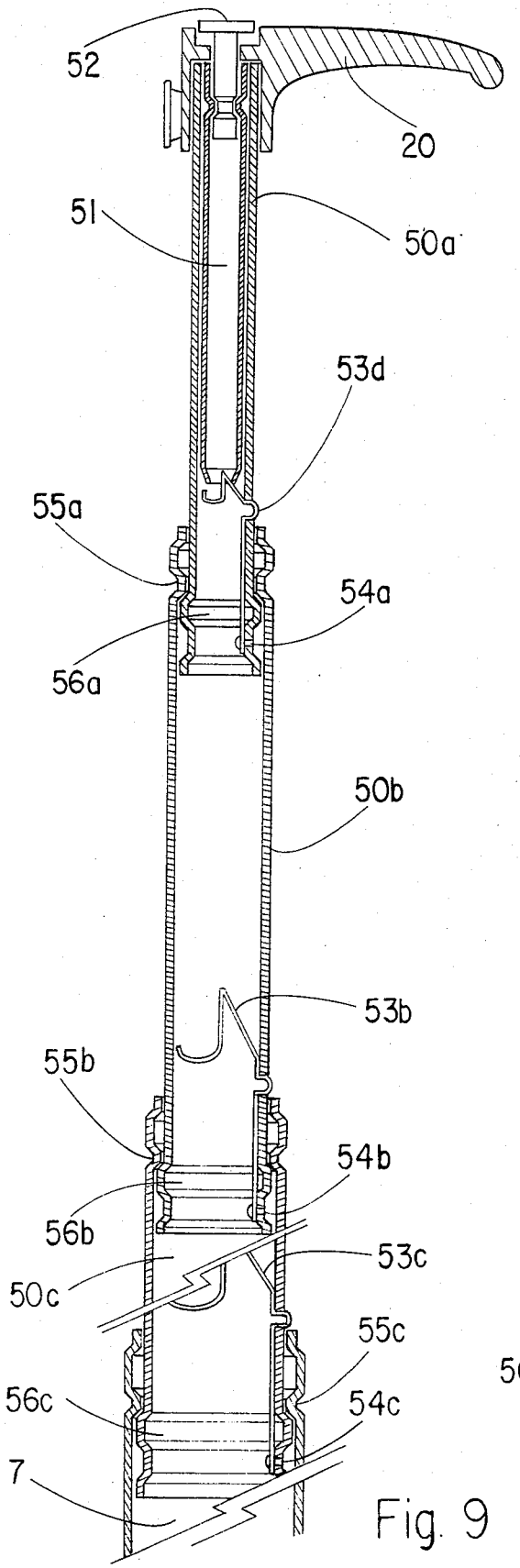
FIGS. 9 and 9*a* are a side elevation of the preferred embodiment of the telescoping pole in an extended position with portions broken away to illustrate the interrelationship of the interior parts and including a blow up of alternative spring clip designs.
Figure 9A:
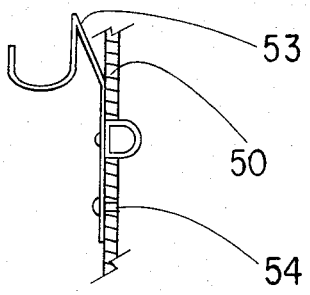

FIG. 9 represents the telescoping pole 50 in the extended, locked position. The pole consists of three tubular sections 50*a*, 50*b* and 50*c*. These three sections telescope one at a time with section 50*a* sliding into section 50*b*, then these two into section 50*c*, and finally all three into the protective cover 7 of the base support unit 17. Regardless of the version of the handle used when the telescoping pole is fully collapsed the handle will rest upon the upper portion of the protective cover inside the concealment zipper 44 completely out of sight.

Within the preferred embodiment the first tubular section 50*a* is an inner tube 51. Atop tube 51 rests the release button 52 which protrudes from the handle. Tube 51 rests upon a spring clip 53*a*. The spring clip is fashioned to provide tension against tube 51 which in turn pushes against the release button 52. The spring clip 53*a* is affixed to the tubular section 50*a* by a rivet 54*a* or another suitable means of fastening. A portion of the spring clip 53*a* protrudes through a hole in tubular section 50*a* and locks this section into the extended position on top of tubular section 50*b*. A bulbous ring 56*a* fashioned into the lower portion of tubular section 50*a* prevents this section from being pulled past the upper lip 55*a* of the second tubular section 50*b*. Tubular sections 50*b* and 50*c* have like spring clips 53*b* and 53*c* with rivets 54*b* and 54*c* respectively. These two sections also have bulbous rings 56*b* and 56*c* to prevent tubular section 50*b* from being pulled past lip 55*b* of tubular section 50*c* and to prevent tubular section 50*c* from being pulled past lip 55*c* of the protective cover 7 of the base support unit 17. Other styles of spring clips may be suitable for use in this invention. Suitable embodiments include clips fashioned in a "u" shape and also clips having attached bullets to protrude from the tubular sections of the telescoping pole.

Figure 10:
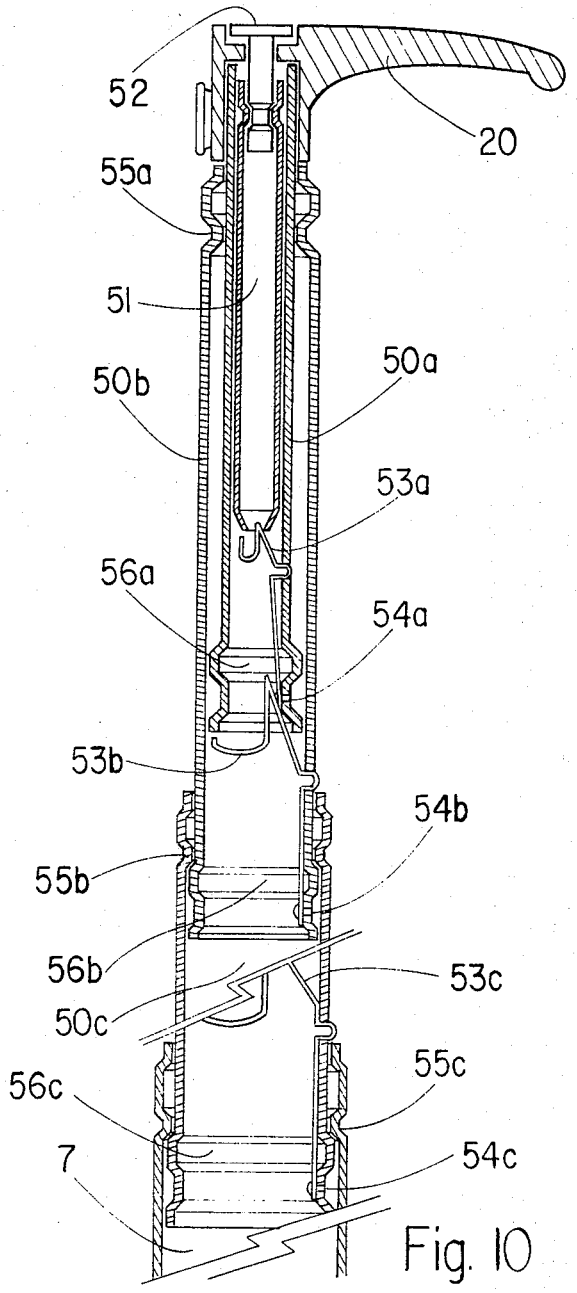
FIG. 10 is a side elevation of the preferred embodiment of the telescoping pole illustrating the interrelationship of the interior parts when the first section is partially collapsed.

FIG. 10 illustrates the telescoping pole with its first tubular section 50*a* collapsed. When release button 52 is depressed the inner tube 51 is pushed against the tension of spring clip 53*a* causing its portion protruding through the hole in tubular section 50*a* and resting upon lip 55*a* to be retracted. When retracted the tension of the spring clip 53*a* still urges the inner tube 51 against release button 52 to keep that button protruding out of the handle. A secondary embodiment of the invention which is less expensive to manufacture does not have an inner tube or release button. Instead an alternative actuation of the collapsing feaure of the telescoping pole is utilized. In this version the operator directly depresses the portion of the clip protruding through the tubular section or may depress a button positioned above the protruding portion of the clip which causes that portion to retract.

When the spring clip 53*a* is retracted tubular section 50*a* may be slid into tubular section 50*b*. When the lower portion of tubular section 50*a* engages the second spring clip 53*b* that clip will be retracted and tubular section 50*b* may then be slid into tubular section 50*c*. As can be seen each tubular section as it is collapsed engages a corresponding spring clip thus allowing the next tubular section to be collapsed until the telescoping pole is fully collapsed and within the protective cover 7 of the base support unit 17.

One embodiment of the invention includes an article of luggage, as described, sold with additional, but separate bags that are designed to fit on the support feet 16*a* and 16*b* and compliment the design of the invention.

While certain preferred embodiments of the present invention have been disclosed in detail, it is to be understood that various modifications in its structure may be adopted without departing from the spirit of the invention or the scope of the following claims.

We claim:

1. A luggage device comprising:

(a) a base support unit having wheels extending downward upon which it may roll;

(b) a garment enclosure which, when in an operable position, has its lower portion attached to said base support unit and its upper portion either folded downwardly or raised upwardly;

(c) a linearly extensible, telescoping pole including means for releasably locking it in an extended position, means for attaching said pole at one end to said base support unit, said pole extending upwardly through only said lower portion of said garment enclosure and having a handle near its other end, means for releasably attaching said handle to the top of said upper portion for supporting said garment enclosure when said pole is extended; and (d) one or more retractable support feet assembled to said base support unit to hold said luggage device upright and to carry additional luggage rested upon them when they are extended outward from said base support unit.

2. A luggage device in accordance with claim 1 wherein a rigid protective sleeve is fixed to said base support unit and extends upward around said telescoping pole.

3. A luggage device in accordance with claim 1 further comprising at least one stretch cord mounted in a tubular pocket formed in said garment enclosure and attached to a slide which slides longitudinally along said pocket between a retracted storage position and an extended position for securing other objects to the luggage device.

4. A luggage device as recited in claim 1 wherein said means for releasably locking said telescoping pole includes a plurality of tubular sections which are locked into said extended position by a plurality of spring clips, a portion of which protrude through holes which are aligned in registration in the tubular section and are retracted by engagement of a relatively interior tubular section, wherein an inner tube is slideably mounted at the upper end of said pole and resiliently biased away from the uppermost spring clip, said tube being connected to a button formed on said handle which may be depressed to move the interior tube against the uppermost spring clip and retract it.

* * * * *